United States Patent [19]

Fischer

[11] Patent Number: 4,541,348

[45] Date of Patent: Sep. 17, 1985

[54] AUTOMATIC SEWING MACHINE FOR PRODUCING A SEAM HAVING A FASTENING SEAM AND A TACKING SEAM

[75] Inventor: Jochen Fischer, Detmold, Fed. Rep. of Germany

[73] Assignee: Kochs Adler AG, Bielefeld, Fed. Rep. of Germany

[21] Appl. No.: 620,190

[22] Filed: Jun. 13, 1984

[30] Foreign Application Priority Data

Jun. 16, 1983 [DE] Fed. Rep. of Germany ..... 3321789

[51] Int. Cl.[4] ..... D05B 21/00

[52] U.S. Cl. ..... 112/121.12; 112/121.15; 112/310

[58] Field of Search ..... 112/121.12, 121.15, 112/121.11, 70, 73, 158 E, 158 R, 310

[56] References Cited

U.S. PATENT DOCUMENTS

| | | | |
|---|---|---|---|
| 3,830,175 | 8/1974 | Levor | 112/121.12 |
| 3,983,825 | 10/1976 | Dobner et al. | 112/121.12 |
| 4,088,085 | 5/1978 | Hager | 112/121.12 |
| 4,160,423 | 7/1979 | Scholl et al. | 112/121.12 |
| 4,282,819 | 8/1981 | Sartor | 112/121.12 |
| 4,347,797 | 9/1982 | Scholl et al. | 112/121.12 |

*Primary Examiner*—H. Hampton Hunter

*Attorney, Agent, or Firm*—Laff, Whitesell, Conte & Saret

[57] ABSTRACT

An automatic sewing machine for producing a seam having a fastening seam and a tacking seam is installed with a sewing head having a bearing bracket with two bearings which are arranged at a distance from each other for receiving a reciprocating needle bar including a needle. A sewing head comprises a drive mechanism to selectably impart jogging movements to the needle bar, wherein the movements form a transmitting ratio with respect to the reciprocating movement of the needle of 1:1 or 1:2.

In order to render possible a shifting of the needle jogging movement during the operation of the machine and under full load, the two bearings guidingly receiving the reciprocating needle bar are oscillatingly drivable independently of each other wherein one bearing is oscillatable at a transmitting ratio of 1:2 and the other bearing is oscillatable at a transmitting ratio of 1:1. Both bearings are drivingly connected to individual drive parts each of which is independently engageable.

7 Claims, 14 Drawing Figures

Fig. 1
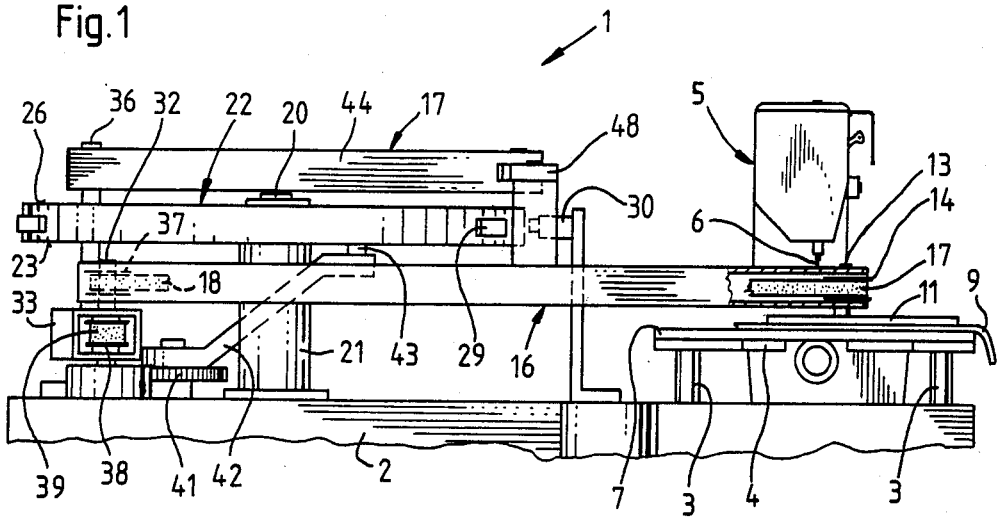
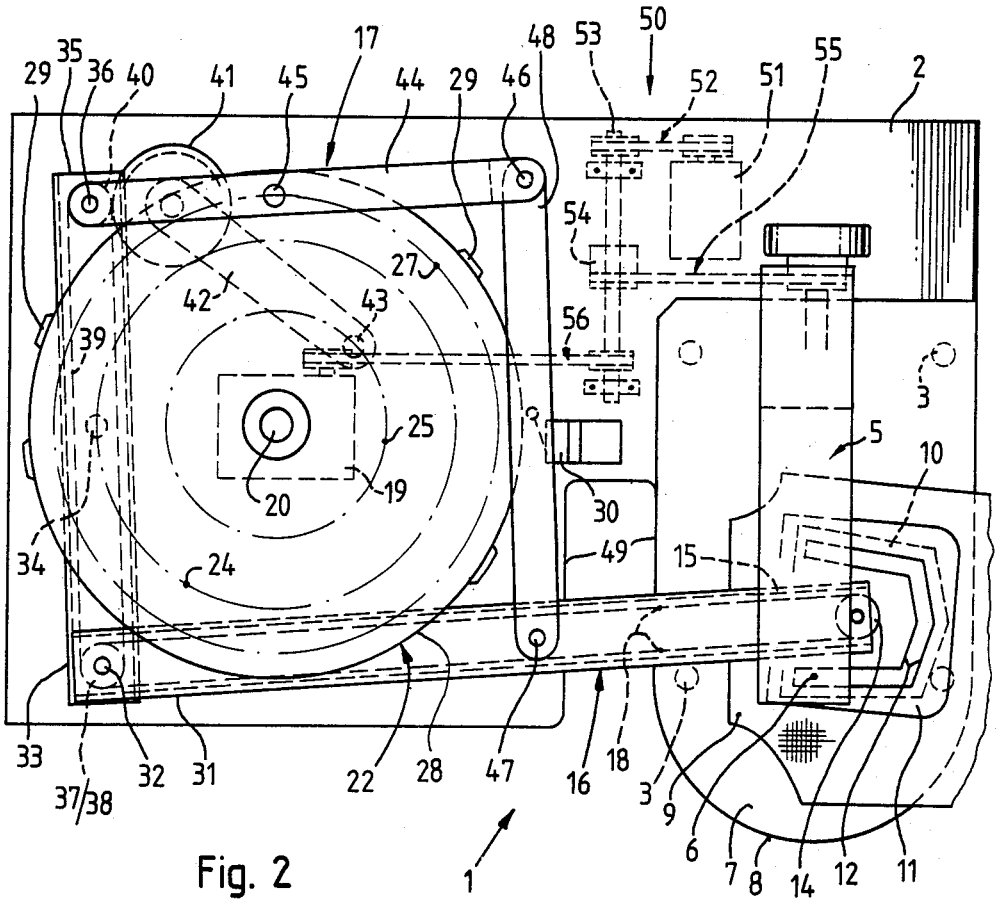
Fig. 2

Fig. 7
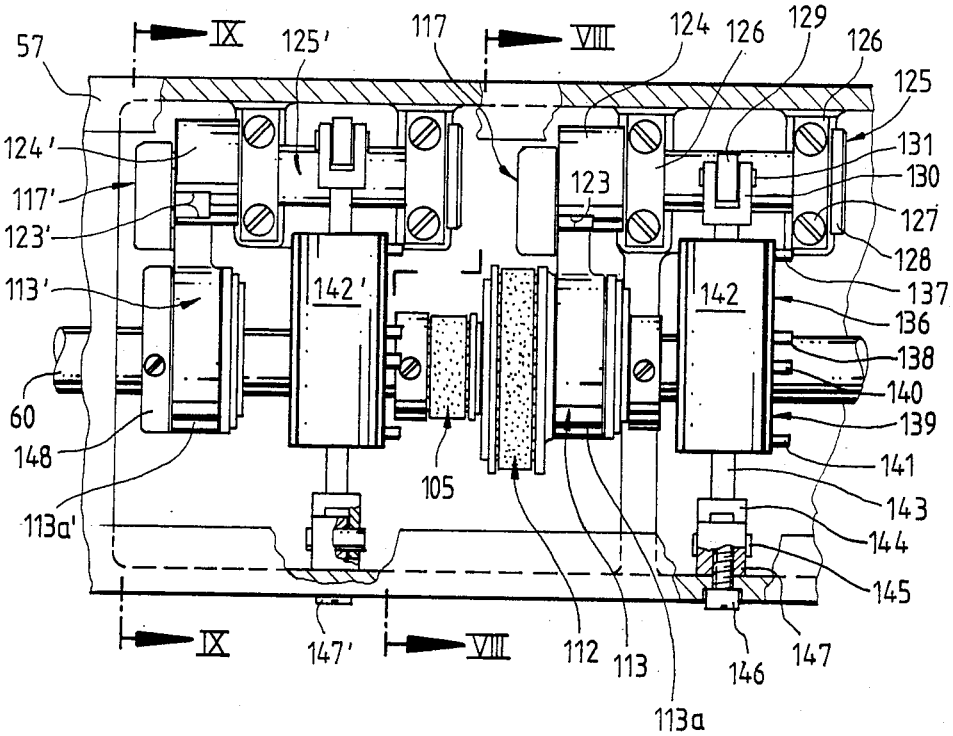
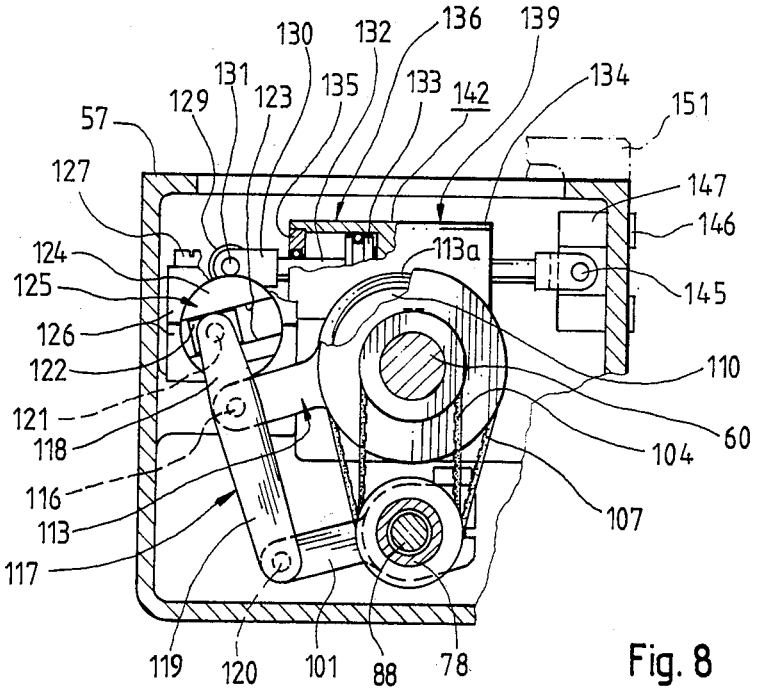
Fig. 8

AUTOMATIC SEWING MACHINE FOR PRODUCING A SEAM HAVING A FASTENING SEAM AND A TACKING SEAM

FIELD OF THE INVENTION

The present invention generally relates to a sewing device for producing a seam having a fastening seam and a tacking seam, which in particular forms a bar tack configuration produced by means of zig-zag-stitching besides normal stitching.

BACKGROUND OF THE INVENTION

In U.S. Pat. No. 4,347,797 there is described an automatic sewing machine incorporating a sewing head, in which the reciprocating needle bar is guidingly received in a tiltably suspended bracket in order to impart to the needle bar besides its main reciprocating movement lateral jogging motions. For this purpose a gear mechanism drivingly connected to the arm shaft is provided, in which two linkage mechanisms operating at different RPM-rates are each selectably connectable to the needle carrying bracket. Due to the transmitting ratio of 1:1 or 1:2 of the linkage mechanism selectable different movements can be generated at the needle.

A disadvantage of this gear mechanism is presented by the fact that this mechanism can be shifted resp. altered with respect to its transmitting ratio at a comparable low RPM-rate, i.e. a shifting can be carried out only up to the maximum of about 80 RPM. Furthermore, such shifting even at low RPM-rates cannot be performed noiselessly and thus not without any wear occuring at elements to be engaged. Moreover, a shifting of this gear mechanism in full operation and under full load is basically not possible.

According to a modified embodiment described in the aforementioned U.S. patent it is proposed to employ two independent drive motors in order to separately generate the two movements of the needle, i.e. the main reciprocating vertical needle movement and the lateral jogging resp. zig-zag movement of the needle. As these motors must be controlled by a computer this presents a cost consuming method.

SUMMARY OF THE INVENTION

It is a main object of the present invention to provide an automatic sewing machine equipped with a sewing head comprising a needle jogging gear mechanism that renders possible a shifting resp. an alteration of a needle jogging movement of a transmitting ratio of 1:1 to 1:n with respect to its vertical main reciprocating movement or vice versa, at which a shifting can be performed under full load and without any limitations due to its operating rate, wherein "n" in the last mentioned proportion stands for the No. 2, 3 or 4.

Another object of the invention is to provide an automatic sewing machine installed with a sewing head having a needle jogging gear mechanism which is reliable in operation and simple in design.

According to the invention, there is provided an automatic sewing machine for producing a seam having a fastening seam and a tacking seam, said machine comprising a sewing head including a bearing bracket oscillating in one plane, a reciprocating needle bar mounted in said bearing bracket and carrying a needle and drive means imparting to said needle bar controllable lateral oscillating movements, the oscillating movement and the needle movement having a transmission ratio of 1:n (with n=2, 3 or 4) and which can be selectively engaged with a control drive of the bearing bracket, an oscillating movement also being produced during the production of the fastening seam, the oscillating movement and the needle movement having a transmission ratio of 1:1; means for receiving and clamping a workpiece; a guiding device for producing a continuous relative movement between the sewing head and a workpiece held by said clamping means in accordance with a predetermined seam course, the guiding device producing the relative movement in the oscillating plane of the bearing bracket during the production of the fastening seam; a first bearing mounting said needle bar in said bearing bracket and being drivable in the transmission ratio 1:n by means of a first drive mechanism and a second bearing mounting said needle bar in said bearing bracket and being drivable in the transmission ratio 1:1 by means of a second drive mechanism, said two bearings being arranged to be oscillatingly driven independent of one another and each drive mechanism being engageable independently of the other.

The objects of the present invention are achieved by the provision of individually oscillatable needle bar receiving bearings, wherein one of which can be oscillated in a transmitting ratio of 1:1 with respect to the arm shaft and wherein the other one of which is oscillatable in a transmitting ratio of 1:n with respect to the arm shaft.

The arrangement of the oscillatable bearings in rocking levers operating about a common axis leads to a simple construction. Due to the 1:1 transmitting ratio it is possible to generate a needle jogging movement at the same frequency as the needle main reciprocating movement, i.e. the needle is moved also at the penetration of the workpiece to be sewn.

As the bearings receiving the needle bar are individually oscillatable by independent drives it is possible to carry out a shifting regardless of the kind of operating condition, i.e. at full load and also at full RPM-rate, e.g. 2500 to 3500. At these two shifting conditions one of the bearings must be brought into a stationary position as the other one will be oscillated by the individually coupled jogging mechanism. Basically it is also possible to arrange the bearings in such a way that the oscillating movements of the bearings are achieved in different planes. This of course then would also require the angular relation of the hook position about the longitudinal needle axis to be controlled.

With the embodiment of the invention it is also proposed to employ the same elements for both the lower and the upper bearing.

According to another feature of the invention a simple construction is achieved to derive oscillating movements of different frequencies from the main drive element of the sewing head, i.e. from the arm shaft of the latter.

According to an embodiment of the invention, it is possible to steplessly alter the amplitude of the individual oscillating movement. Moreover, it is proposed to provide an additional mechanism to limit the adjustments for altering the amplitude in a simple manner.

Other objects, advantages and features of the present invention will appear from the detailed description of the preferred embodiment including an additional embodiment of the control mechanism, which will now be explained in conjunction with the accompanying drawings.

BRIEF DESCRIPTION OF THE DRAWINGS

FIG. 1 is a front view of one embodiment of an automatic sewing machine according to the invention;

FIG. 2 is a top plan view of the automatic sewing machine shown in FIG. 1;

FIG. 7 is a partial top plan view of the arm of the sewing head taken in the direction of the arrow VII in FIG. 4 but with the cover removed;

FIG. 8 is a sectional view of the arm of the sewing head taken on the line VIII—VIII in FIG. 7 in the direction of the arrows;

DESCRIPTION OF PREFERRED EMBODIMENTS

Figure 5:
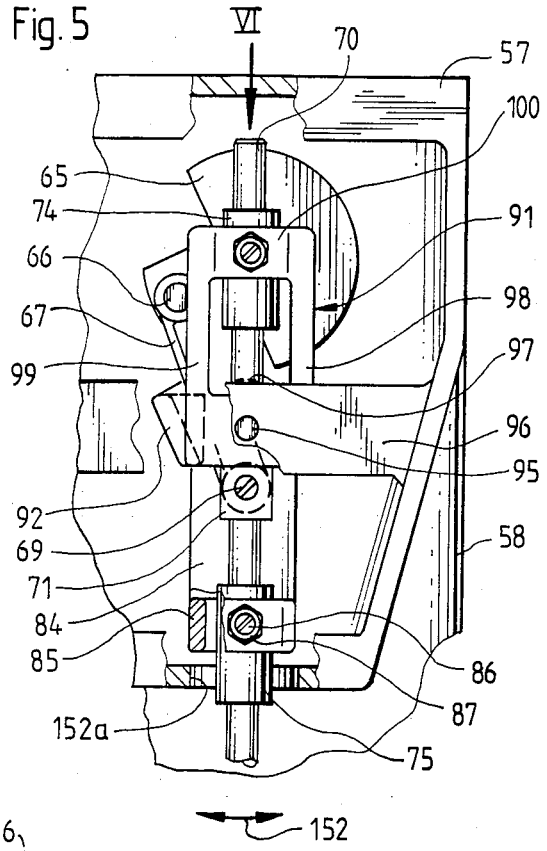
FIG. 5 is a partial front view of the arm of the sewing head taken in the direction of the arrow V in FIG. 4 but with the cover removed.
Figure 6:
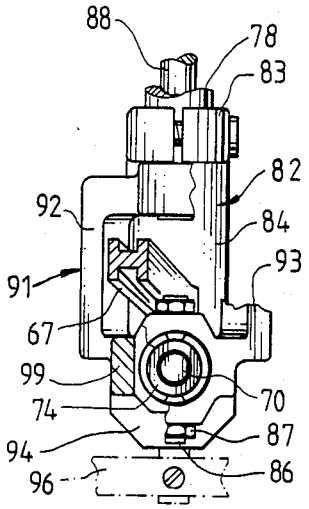
FIG. 6 is a top plan view, partially in section of the driving elements of the sewing head taken in the direction of the arrow VI in FIG. 5.

Referring to FIGS. 1 and 2 there is illustrated an automatic sewing machine mounted on a stand 2 having a plate 4, which is fastened thereto by means of posts 3 for receiving a sewing head 5 with a needle 6. On the plate 4 there is arranged a workpiece supporting plate 7 extending with a semicircular portion 8 around the needle 6 of the sewing head 5 (FIG. 2). On the workpiece supporting plate 7 there is clamped a workpiece cut 9 together with a pocket cut 10 by means of a clamping plate 11 having a U-shaped recess 12, along which the workpiece cut 9 and the pocket 10 are to be sewn together.

The clamping plate 11 is installed with a shaft 13 and a timing belt pulley 14, at which the shaft 13 is pivoted in one end 15 of a square-formed tubular arm 16 of a guiding device 17. The timing belt pulley 14 co-operates with a timing belt 18 located in the arm 16. The timing belt 18 serves to rotate the clamping plate 11 into a determined angular position with respect to the arm 16 as hereinafter described.

Within the stand 2 there is arranged a gear 19, a vertical shaft 20 of which is pivoted in a tube 21 and carries a control cam 22 which is provided at its lower surface 23 with two grooves 24, 25, at its upper surface 26 with a groove 27 and at its periphery 28 with a cam 29 for actuating a switch 30.

The other end 31 of the arm 16 of the guiding device 17 is linked by means of a shaft 32 to a lever 33, which carries a cam follower 34 co-operating with the groove 24. The free end 35 of the lever 33 is pivoted to an axis 36 of the stand 2. Within the arm 16 the shaft 32 is provided with a timing belt pulley 37 receiving the timing belt 18. A further timing belt pulley 38 arranged within the square-formed tubular lever 33 receives a further timing belt 39, which extends within the lever 33 and co-operates with a timing belt pulley 40 pivoted on the axis 36. The timing belt pulley 40 is provided with a pinion (not shown), which meshes with a gear wheel 41 mounted on a lever 42. The lever 42 is pivoted about the center axis of the gear wheel 41 located at the stand 2. The free end of the lever 42 carries a cam follower 43 cooperating with the groove 25 formed at the lower surface 23 of the control cam 22.

The axis 36 firmly connected to the stand 2, receives a further lever 44, which is provided with a cam follower 45 co-operating with the groove 27 formed at the upper surface 26 of the control cam 22. The free end of the lever 44 is linked to the arm 16 by means of bolts 46, 47 and a connecting bar 48. The levers 33, 44, the arm 16 and the connecting bar 48 form a linkage mechanism having the shape of a parallelogram.

Between the workpiece supporting plate 7 and the connecting bar 48 the stand 2 is formed with a recess 49 extending parallelly with respect to the sewing head 5. Furthermore, inside of the stand 2 there is provided a drive mechanism 50. A motor 51 of said drive mechanism 50 drives a shaft 53 via a belt drive 52. The shaft 53 is drivingly connected to the sewing head 5 by means of a clutch 54 and a belt drive 55. Moreover, the shaft 53 is connected to the gear 19 by means of a belt drive 56.

Figure 3:
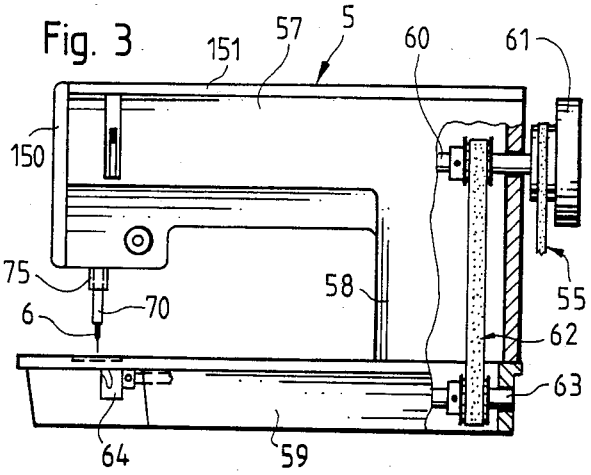
FIG. 3 is a partially broken open longitudinal view of the sewing head of the automatic sewing machine, on an enlarged scale.

As illustrated in FIG. 3, the sewing head 5 is formed with an overhanging arm 57 connected to a base plate 59 by means of a standard 58. In the arm 57 there is pivoted an arm shaft 60, the outer free end of which is provided with a handwheel 61. The arm shaft 60 is driven by the belt drive 55 and drivingly connected via a timing belt drive 62 located in the standard 58 to a shaft 63 located in the base plate 59. Furthermore, in the base plate 59 there is pivoted a looptaker 64, which is driven via a spur gearing (not shown) by the shaft 63.

Figure 4:
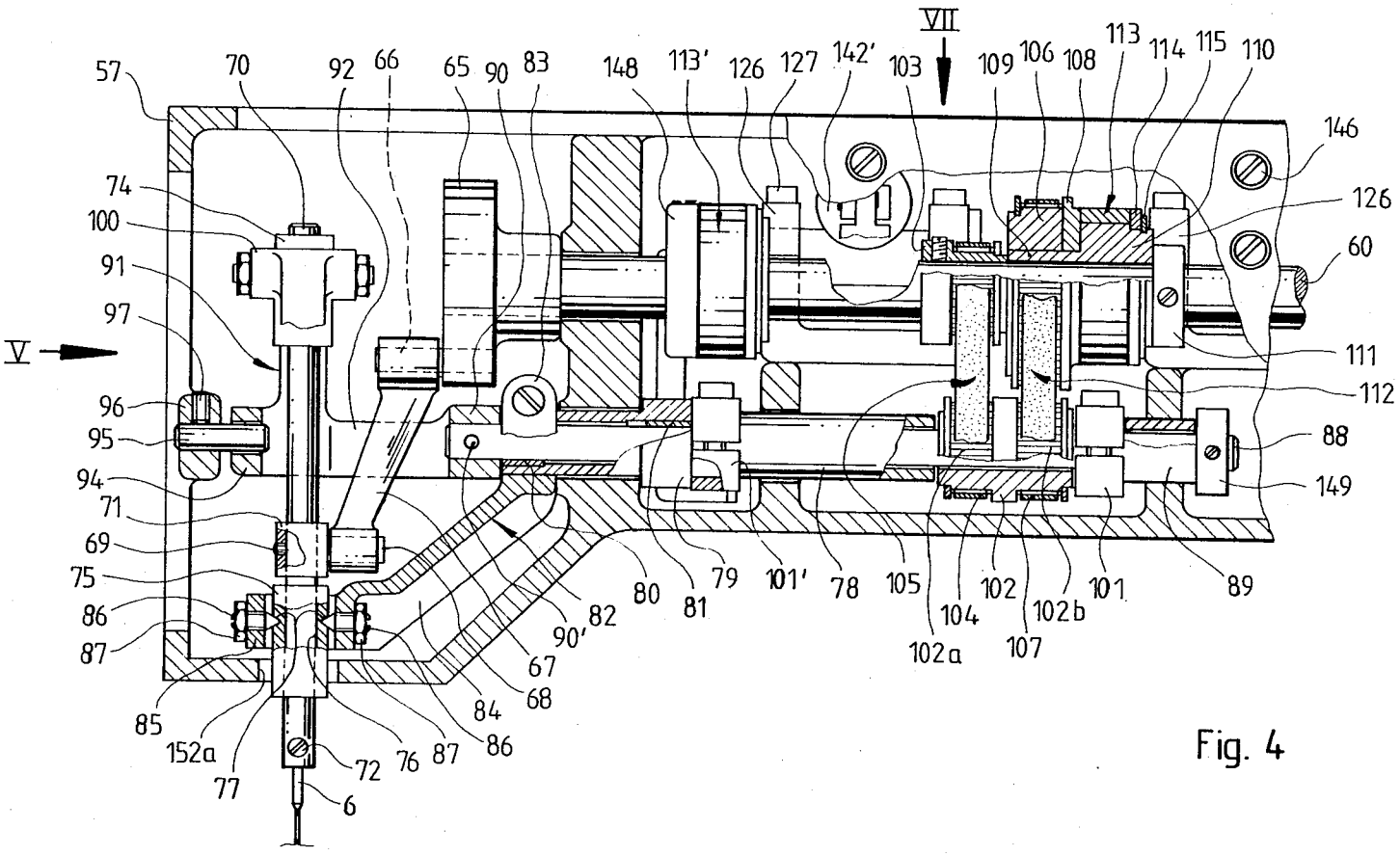
FIG. 4 is a vertical longitudinal section taken through a part of the arm of the sewing head illustrated in FIG. 3, on an enlarged scale.

As illustrated in FIG. 4, the arm shaft 60 terminates in a crank 65 with a crank pin 66 receiving the upper end of a needle bar drive lever 67. The lower end of the needle bar drive lever 67 is pivoted on a lug 68 forming a part of a drive member 71 secured to a needle bar 70 by means of a setscrew 69. To the lower end of the needle bar 70 there is fastened the needle 6 by means of a setscrew 72. The needle bar 70 is displaceably received in an upper bearing 74 and a lower bearing 75. As the bearings 74, 75 are formed identically, hereinafter only the lower bearing 75 is described. This bearing 75 is formed as a hollow cylinder with an inner cylindrical bearing surface 76 for receiving and guiding the needle bar 70. Furthermore, the lower bearing 75 is provided with two outer conical recesses 77 arranged on an axis extending perpendicularly and diametrically with respect to the longitudinal axis of the bearing surface 76.

In the overhanging arm 57 of the sewing head 5 there is pivoted a hollow shaft 78 extending below and parallelly to the arm shaft 60. The hollow shaft 78 is formed with a shoulder 79 and two bearings 80, 81. To the end of the hollow shaft 78 turned to the needle bar 70 there is secured a lever 82 by means of a clamping member 83. In its middle area 84 the lever 82 has a downwardly opened U-shaped profile. The free end of the lever 82 is provided with a ring 85 surrounding with play the lower bearing 75 of the needle bar 70. Two screws 86 are screwed into the ring 85 and secured by lock nuts 87. At their ends directed to the center of the ring 85, the screws are formed with points (not denoted) engaging the conical recesses 77 of the lower bearing 75 as the bearing 75 is freely swingable about them. The afore-described connection of the lower bearing 75 of the needle bar 70 to the lever 82 ensures that the lower bearing 75 is swingable about an axis defined by the position of the points and the conical recesses 77 extending parallel with respect to the hollow shaft 78 resp. the arm shaft 60.

Within the hollow shaft 78 there is rotatably received in bearings 80, 81 an inner shaft 88, the other end of which turned to the handwheel 61 is rotatably supported in a further bearing 89 located in the overhanging arm 57 of the sewing head 5. The end turned to the needle bar 70 engages a connecting member 90 of a rocking lever 91 secured thereto by means of a pin 90'. The rocking lever 91 is formed with two ribs 92, 93 embracing the needle bar drive lever 67 with clearance. The outer ends of the ribs 92, 93 are firmly connected to the connecting member 90. From here they diverge in an acute angle in order to terminate in a connecting web 94. The connecting web 94 is provided with a bore (not denoted), in which rotatably engages a pivot pin 95. The pivot pin 95 is secured to a rib 96 of the overhanging arm 57 of the sewing head 5 by means of a setscrew 97. Consequently, the rocking lever 91 is swingable about an axis extending coaxially with respect to the longitudinal axis of the hollow shaft 78 resp. the inner shaft 88.

Two ribs 98, 99 each extend from the ribs 92, 93 upwardly to the upper bearing 74 of the needle bar 70 and terminate in a ring 100. For receiving the upper bearing 74 the ring 100 is formed according to the already described ring 85 of the lever 82. By the connection of the upper bearing 74 to the lever 91 it is ensured that also the upper bearing 74 is swingable about an axis extending parallelly to the hollow shaft 78 resp. the inner shaft 88. As the needle bar 70 is supported in the upper bearing 74 and the lower bearing 75 in order to allow a longitudinal displacement, the two bearings 74, 75 are relatively positioned in alignment.

To the inner shaft 88 there is clamped a lever 101 axially supporting a double gear wheel 102, which is pivoted to the inner shaft 88. The double gear wheel 102 is provided with two identical toothed rims **102*a* and 102*b***.

The toothed rim **102*a* is connected via a timing belt 104 to a gear wheel 103 having the same diameter. The timing belt pulley 103 is pivoted to the arm shaft 60. Thus, the timing belt drive 105 formed by the toothed rim 102*a* of the double gear wheel 102, the timing belt 104 and the timing belt pulley 103, has a transmitting ratio of 1:1. The other toothed rim 102*b* of the double gear wheel 102 is connected via a timing belt 107 to a timing belt pulley 106 having a double large diameter than the toothed rim 102*b*. The timing belt pulley 106 is pressed together with a thrust washer 108 onto a tubular shoulder 109 of an eccentric 110. The eccentric 110 is pivoted to the arm shaft 60 and axially secured in one direction by the timing belt pulley 103 and in the other direction by a collar 111 fastened to the arm shaft 60. The timing belt drive 112 formed by the toothed rim 102*b* of the double gear wheel 102, the timing belt pulley 106 and the timing belt 107, has a transmitting ratio of 1:2. Consequently, the eccentric 110 is driven by the timing belt drives 105, 112 at the half RPM-rate of the arm shaft 60**.

The eccentric 110 is movably embraced by an eye **113*a* of a pitman 113. The eye 113*a* of the pitman 113 is axially guided by the thrust washer 108 and a disc 114 arranged on the eccentric 110 and fastened thereto by means of a retaining ring 115. Thus, by the guidance of the eye 113*a* also the pitman 113** itself is kept in position.

The free end of the pitman 113 is swingably connected to a double armed lever 117 by means of a bolt 116. The double armed lever 117 is formed with an upper arm 118 and a lower arm 119. The lower arm 119 is swingably connected via a bolt 120 to the free end of the lever 101. At the free end of the upper arm 118 there is fastened via a bolt 121 a guide block 122. The guide block 122 is displaceably supported in a guideway 123, which is formed in a shoulder 124 of an adjustment shaft 125. The adjustment shaft 125 is rotatably received in two split bearings 126 mounted to the overhanging arm 57 of the sewing head 5 and secured thereto by means of screws 127. On the one hand the adjustment shaft 125 is secured against axial displacement by the shoulder 124 and on the other hand by an oppositely arranged shoulder 128. Furthermore, to the adjustment shaft 125 there is fastened a radially extending lever 129. To the end of the lever 129 there is hinged a fork 130 by a bolt 131. The fork 130 is a part of a piston rod 132, the free end of which is provided with a piston 133. The piston 133 together with the piston rod 132 is received in a cylindrical housing 134 and displaceable in the longitudinal direction of the piston rod 132. At the exit end of the piston rod 132 the housing 134 is closed by a cover 135. The housing 134 defines together with the piston 133 and the piston rod 132 a first drive element 136, which is movable between two end positions and provided with connections 137, 138 for air pressure supply. Furthermore, the housing 134 receives a second drive element 139, which corresponds in construction with the first drive element 136 and is provided with connections 140, 141 for air pressure supply. The first drive element 136 and the second drive element 139 form a pneumatic control drive 142 shiftable into several—maximal four—shifting positions. At the free end of its piston rod 143 the second drive element 139 is formed with a fork 144 hinged by a bolt 145 to a bearing 147 located at the overhanging arm 57 of the sewing head 5 and secured thereto by a screw 146.

On the contrary to the afore-described part of the gear mechanism provided with an eccentric 110 freely rotatable on the arm shaft 60, the hereinafter described part of the gear mechanism is provided with an eccentric 148, which is firmly secured to the arm shaft 60. The eccentric 148 is similarly connected with further elements as already described in conjunction with the aforesaid part of the gear mechanism so as to produce variable oscillatory movements at the hollow shaft 78. As the construction of this part of gear mechanism corresponds to the already described part of the gear mechanism, the same or comparable components are denoted with the same reference numerals but with the addition of a prime. Insofar, it may be referred to the above description. However, the lever 101' is not clampingly connected to the inner shaft 88 as the lever 101 but to the hollow shaft 78.

As is clear from FIG. 4, the end of the inner shaft 88 turned to the handwheel 61 is provided with a collar 149. At its front and upper surface the overhanging arm 57 of the sewing head 5 is closed by removable covers 150, 151 (FIG. 3).

Operation of the described automatic sewing machine is as follows:

After the workpiece cut 9 and the pocket cut 10 are clamped together by means of the clamping plate 11, the sewing procedure may be initiated. The shaft 53 is driven via the belt drive 52 by the motor 51 for driving on one hand the sewing head 5 via the clutch 54 and the belt drive 55, and, on the other hand, the gear 19 via the belt drive 56. The control cam 22 is driven via the vertical shaft 20 of the gear 19. Due to the co-operation of the cam followers 34, 35 with the grooves 24, 27, the arm 16 and the clamping plate 11 are displaceable parallelly with respect to the workpiece supporting plate 7 in both associated co-ordinate directions. Due to the co-operation of the cam follower 43 with the groove 25, the clamping plate 11 may also be rotated about the shaft 13 via the timing belts 39, 18. Consequently and according to the above described manner, any movement of the workpieces 9, 10 relative to the needle 6 may be achieved.

The co-operation of the cams 29 located at the periphery of the control cam 22, with the stationarily arranged switch 30 renders possible further control functions, i.e. for actuating the clutch 54 allowing an idling movement of the clamping plate 11 without simultaneously driving the sewing head 5, stopping the motor 51 at the end of a sewing cycle, or releasing shift functions within the sewing head 5. The geometrical contour of the seam to be produced in the workpieces 9, 10 is defined by the configuration of the grooves 24, 25, 27 provided in the control cam 22. Of course, the contour of the grooves 24, 25, 27 and thus the contour of the seam must correspond to the profile of the recess 12. The function as so far described is known from U.S. Pat. No. 4,347,797.

When the sewing head 5 is operated, on the one hand the arm shaft 60 drives via the timing belt drive 62 and the shaft 63 the looptaker 64 arranged in the base plate 59, and possibly further commonly employed elements. On the other hand the arm shaft 60 drives the needle bar 70 with the needle 6 in the usual vertical reciprocating direction via the crank 65, the needle bar drive lever 67 and the drive member 71.

As the needle bar 70 is supported in the bearings 74, 75, which are independently swingable to each other, it is possible to impart to the needle bar 70 regardless of its vertically directed stroke movement also a lateral jogging motion extending in direction of the arrow 152 (FIG. 5), i.e. in the regular sewing direction.

The eccentric 110 drivingly connected to the arm shaft 60 via the timing belt drives 105, 112 steadily imparts rocking motions by means of the pitman 113 to the double armed lever 117. As is clear from FIG. 8, the adjustment shaft 125 is positioned in a neutral position due to the position of the control drive 142.

In such a neutral position the guideway 123 situated in the stud 124 of the adjustment shaft 125 longitudinally extends in an axis perpendicularly positioned with respect to an axis crossing the center of the bolt 120 and the axis of rotation of the adjustment shaft 125. In such position the pitman 113 imparts only a rocking movement to the double armed lever 117, which oscillates about the center of the bolt 120 and which is linearly oscillated due to the movement of the guide block 122 in the guideway 123. Essentially, the double armed lever 117 does not impart rocking movements in its longitudinal main direction regardless of minor movements due to the linear extension of the guideway 123 instead of an extension according to an arc having a center corresponding to the center line of the bolt 120. Consequently, no oscillating movement is imparted to the inner shaft 88 including the upper bearing 74 by means of the firmly connected lever 101, i.e. the upper bearing 74 receiving the needle bar 70 is kept stationary.

Figure 10:
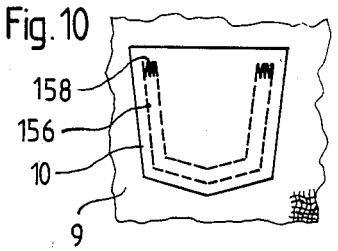
FIG. 10 shows a workpiece comprising a workpiece cut with a pocket cut sewn thereon by a double seam produced by the automatic sewing machine according to the invention.
Figure 11:
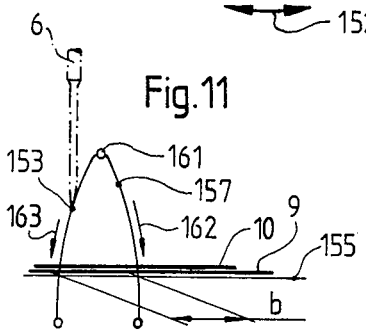
FIG. 11 shows the path of motion of the laterally vibrating needle point when sewing tack switches.
Figure 12:
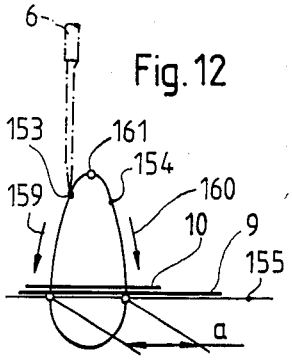
FIG. 12 shows the path of motion of the laterally vibrating needle point when sewing fastening stitches.

Due to the rotation of the arm shaft 60 furthermore, the eccentric 148 imparts rocking movements via the pitman 113' and thus also the double armed lever 117'. According to FIG. 9 by the extended piston rods 132' and 143' of the control drive 142' the adjustment shaft 125' is tilted in such a position, in which the guideway 123' located in the stud 124' is tilted in a counterclockwise direction. Due to this tilted position of the guideway 123', the double armed lever 117 is now exposed also to a component of movement extending in the longitudinal direction. Due to the movement of the double armed lever 117', the guide block 122' rocks in the guideway 123' causing an oscillating movement of the lever 101' and thus also an oscillating movement of the hollow shaft 78. The hollow shaft 78 transmits its oscillating movements by means of the lever 82 to the lower bearing 75, which extends out of the arm 57 with play through an opening **152*a*. As the eccentric 148 is firmly connected with the arm shaft 60 the needle bar 70 and thus the needle 6 performs a complete lateral movement as the needle 6 describes a complete movement of stroke. At these superimposed movements, the tip 153 of the needle 6 travels along the closed path 154 as illustrated in FIG. 12. In FIGS. 11 and 12 the upper side 155 of the workpiece supporting plate 7 is illustrated by a line parallelly extending to the individual direction of stitching. The dimension "a" indicates the distance which the tip 153 of the needle 6 travels as the needle 6 penetrates the workpiece cut 9 and the pocket cut 10 to be sewn together. Since the needle 6 performs beside the necessary vertical main movement additionally also a lateral movement which takes place also as the workpieces 9, 10 are being penetrated by the needle 6, the movement of the latter will be considered as a needle feed movement. Due to the coaction of the guiding device 17 moving the workpieces 9, 10 with respect to the needle 6 in conjunction with the superimposed movements of the needle 6 according to the path 154 the workpieces 9, 10 are stitched together by a fastening seam 156 (FIG. 10). As additionally the tilting of the clamping plate 11 about the shaft 13 by means of the groove 25 is carried out, the workpieces 9, 10 to be stitched are so aligned that the oscillating movement according to the arrow 152 of the needle 6 is always kept tangential with respect to the individual direction of the fastening seam 156** at its particular position of stitching.

After the termination of the fastening seam 156, the switch 30 will be triggered by one of the cams 29 situated at the control cam 22, by which the control drives 142, 142' are so shifted that the adjustment shaft 125' will be brought into a neutral position as already described in conjunction with the position of the adjustment shaft 125 and the adjustment shaft 125 will be brought into a tilted position, offset with respect to the neutral position. In these positions of the adjustment shafts 125 and 125', the lower bearing 75 will now be kept stationary and the upper bearing 74 will be rockingly moved. Due to the drive of the eccentric 110 via the timing belt drive 112 the RPM-rate of the eccentric 110 is half of that of the arm shaft 60 i.e. the transmitting ratio 1:2 becomes effective. Due to this action, the upper bearing 74 is exposed to an oscillating movement at which the tip 153 of the needle 6 travels along a path 157 as illustrated in FIG. 11. At this movement the needle 6 describes two complete stroke movements as one lateral movement according to the direction of the arrow 152 is completed. At this kind of movement the needle 6 almost does not carry out a movement in the direction of the arrow 152 while penetrating the workpieces 9, 10. This becomes clear from FIG. 11 as the contour of the path 157 extends almost vertically with hardly any lateral movement from the upper side 155 of the workpiece supporting plate 7 downwardly. At this kind of movement a tacking seam 158 will be produced composed of individual zig-zag switches. This kind of movement of the needle 6 is also referred to as a zig-zag movement. The dimension "b" illustrated in FIG. 11 represents the amplitude of the needle 6 at the upper side 155 of the workpiece supporting plate 7 which corresponds to the bight of the zig-zag stitches of the tacking seam 158.

Figure 9:
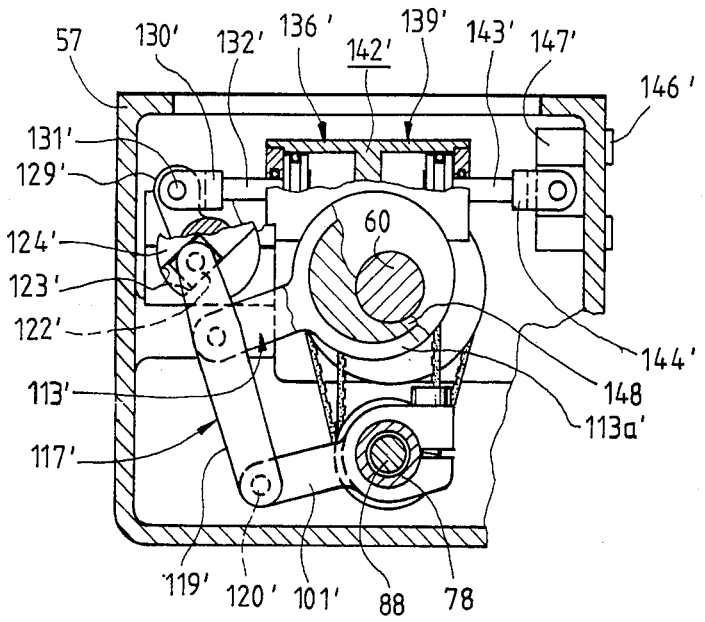
FIG. 9 is a partial section of the arm of the sewing head taken on the line IX—IX in FIG. 7 in the direction of the arrows.

Dependent on the shift condition of the control drive 142—at extended piston rods 132, 143 or retracted piston rods 132, 143, it may be achieved that the adjustment shaft 125 will be tilted in a clockwise resp. a counterclockwise direction. For example, the extended position of the corresponding piston rods 132', 143' is shown in FIG. 9, in which the adjustment shaft 125' is tilted to its final counterclockwise directed position. Due to this kind of angular position of the adjustment shaft 125', it is achieved that the tip 153 of the needle 6 moves along the path 154 in the direction of the arrow 159 resp. in opposite direction of the arrow 160. In the same manner, it can be achieved by positioning the adjustment shaft 125 accordingly, that the tip 153 of the needle 6 moves on the path 157 beginning from its upper position 161 at first in the direction of the arrow 162 resp. in the direction of the arrow 163 at the production of the tacking seam 158.

The activation of the control drives 142, 142' should be so interlocked as to expose one of the bearings 74, 75 to a rocking movement only.

As the angular position of the adjustment shafts 125, 125' determines the direction in which the tip 153 of the needle 6 moves along the paths 154 resp. 157 the value of the angle by which the shafts 125 resp. 125' are adjusted determines the amplitude denoted by the dimension "a" resp. "b" indicating the distance of movement of the tip 153 of the needle 6 at the upper side 155 of the workpiece supporting plate 7. Such different amplitudes are achievable by means of control drives, at which the first drive element 136 resp. 136' and the second drive element 139 resp. 139' can carry out adjustable strokes in order to render possible angular adjustments of different angles and thus the generation of different amplitudes in the one or the other swing direction. The adjustment shafts 125 resp. 125' may be angularly displaced of course for such an angle only as to still assure an unobstructed movement of the guide blocks 122, 122' in the corresponding guideways 123, 123'. For example, such adjustment may be for about an angle of 20° with reference to the neutral position of the adjustment shaft 125 resp. 125'.

Figure 13:
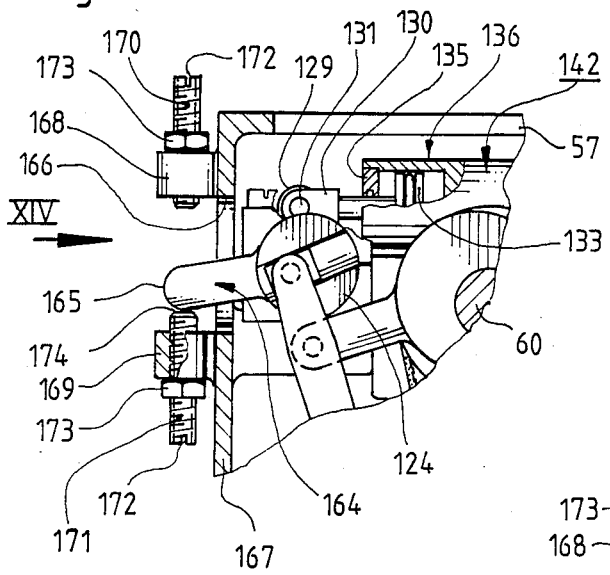
FIG. 13 is a partially sectional view according to FIG. 8 providing a stepless adjustable adjusting shaft.
Figure 14:
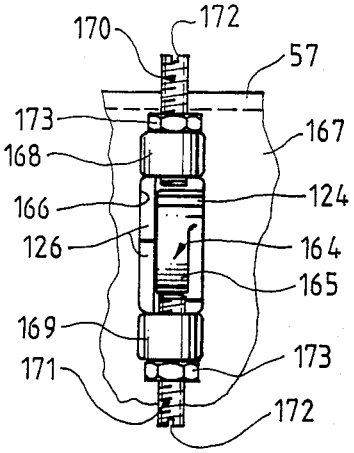
FIG. 14 is a partial side elevation of the arm of the sewing head taken in the direction of the arrow XIV in FIG. 13.

In FIGS. 13 and 14 a modified construction is illustrated showing the possibility for limiting the angular adjustment of the adjustment shaft 125. The adjustment shaft 125 is formed at its stud 124 with an arm 164 profiled with a rounded free end 165. The arm 164 reaches with clearance through an opening 166 profiled in a wall 167 of the arm 57. At the wall 167 there are centrally arranged an upper lug 168 and a lower lug 169 with respect to the opening 166. Both lugs 168, 169 are each formed with bores including threads (not denoted), at which both bores are aligned to each other. The threaded bore of the upper lug 168 receives a threaded bolt 170 and the threaded bore of the lower lug 169 receives a threaded bolt 171. Both bolts 170, 171 are each formed with a respective slot 172 for a screwdriver and are secured in the respective lugs 168, 169 by means of respective lock nuts 173.

According to FIG. 13, the adjustment shaft 125 is displaced by the action of the control drive 142 into a final position in a counterclockwise direction, in which the rounded end 165 abuts against the front side 174 of the lower threaded bolt 171. In this shift position the piston 133 does not contact the cover 135, i.e. the first drive element 136 does not reach its maximal possible extended position.

A similar modification can be provided for the adjustment shaft 125'. By the possibility for limiting the amount of angular adjustment of the adjustment shaft 125 resp. 125' the amplitude of each generated oscillating movement can be steplessly altered, wherein the maximum possible extension of the individual drive element 136, 139 resp. 136', 139' corresponds to a dimension for the maximum possible amplitude. By the alteration of the stops, i.e. adjusting the threaded bolts 170 and 171, the amplitude can be accordingly decreased.

The invention is not restricted to the above-described embodiments but modifications and variations may be made without departing from the spirit and scope of the invention as defined by the appended claims.

What is claimed is:

1. An automatic sewing machine for producing a seam having a fastening seam and a tacking seam, said machine comprising a sewing head including a bearing bracket oscillating in one plane, a reciprocating needle bar mounted in said bearing bracket and carrying a needle and drive means imparting to said needle bar controllable lateral oscillating movements, the oscillating movement and the needle movement having a transmission ratio of 1:n (with n=2, 3 or 4) and which can be selectively engaged with a control drive of the bearing bracket, an oscillating movement also being produced during the production of the fastening seam, the oscillating movement and the needle movement having a transmission ratio of 1:1; means for receiving and clamping a workpiece; a guiding device for producing a continuous relative movement between the sewing head and a workpiece held by said clamping means in accordance with a predetermined seam course, the guiding device producing the relative movement in the oscillating plane of the bearing bracket during the production of the fastening seam; a first bearing mounting said needle bar in said bearing bracket and being drivable in the transmission ratio 1:n by means of a first drive mechanism and a second bearing mounting said needle bar in said bearing bracket and being drivable in the transmission ratio 1:1 by means of a second drive mechanism, said two bearings being arranged to be oscillatingly driven independent of one another and each drive mechanism being engageable independently of the other.

2. An automatic sewing machine as claimed in claim 1, wherein said bearings are arranged to be oscillatingly driven by means of aligned-supported rocking levers.

3. An automatic sewing machine as claimed in claim 2, wherein the rocking levers are fitted to two shafts which are concentric to one another.

4. An automatic sewing machine as claimed in claim 1, wherein each said drive mechanism has an eccentric, whereof one constantly rotates with a speed corresponding to the reciprocating movement of the needle bar whilst the other constantly rotates with a correspondingly reduced speed.

5. An automatic sewing machine as claimed in claim 4, wherein each eccentric engages on a double armed lever, whereof one end is articulated to a lever fitted in non-rotary manner to a shaft and whose other end is guided in an adjustable guideway.

6. An automatic sewing machine as claimed in claim 5, wherein the said guideway is connected to an adjustment shaft which is angularly adjustable by means of a control drive.

7. An automatic sewing machine as claimed in claim 6, wherein means are provided for limiting the adjustment angle of said adjustment shaft.

* * * * *